US008062108B2

(12) United States Patent
Carlson et al.

(10) Patent No.: US 8,062,108 B2
(45) Date of Patent: Nov. 22, 2011

(54) MAGNETICALLY ACTUATED AUTO-CLOSING AIR VENT

(76) Inventors: Thomas R. Carlson, Santa Rosa, CA (US); Rados R. Marusic, Santa Rosa, CA (US); Theresa Carlson-Marusic, Santa Rosa, CA (US)

( * ) Notice: Subject to any disclaimer, the term of this patent is extended or adjusted under 35 U.S.C. 154(b) by 881 days.

(21) Appl. No.: 12/098,185

(22) Filed: Apr. 4, 2008

(65) Prior Publication Data

US 2008/0248739 A1 Oct. 9, 2008

Related U.S. Application Data

(60) Provisional application No. 60/910,142, filed on Apr. 4, 2007.

(51) Int. Cl.
*A62C 2/12* (2006.01)

(52) U.S. Cl. ..... 454/369; 454/257; 454/904; 137/79

(58) Field of Classification Search ..... 454/369, 454/284; 52/1; 169/56
See application file for complete search history.

(56) References Cited

U.S. PATENT DOCUMENTS 3,650,069 A 3/1972 Alley
4,080,978 A 3/1978 McCabe
4,398,371 A * 8/1983 Jenkins ..... 49/7
6,676,508 B1 1/2004 Graham
6,681,863 B1 1/2004 Odelros
7,018,289 B2 3/2006 Heil
7,413,024 B1 * 8/2008 Simontacchi et al. ..... 169/48

FOREIGN PATENT DOCUMENTS

GB 2208094 A * 2/1989

* cited by examiner

*Primary Examiner* — Steven B McAllister
*Assistant Examiner* — Brittany E Towns
(74) *Attorney, Agent, or Firm* — Craig M. Stainbrook; Stainbrook & Stainbrook, LLP

(57) ABSTRACT

A self-closing vent intended for use in attics, crawl spaces, joist cavities, exterior walls, interior walls, or other structural element which allows for the free flow of air from outside a building to interior spaces during normal use. The vent includes a damper blade pivotally connected to, and disposed within, the vent housing, which is held in an open position by a temperature sensitive fusible link. Two, and preferably three, permanent magnets provide the force for driving the damper blade into a closed and locked position. A first magnet disposed in a side of the vent housing and a second magnet disposed on the damper blade are disposed with opposing (repelling) polarities when the damper blade is held in the open position. A third magnet disposed proximate the back of the vent housing is oriented so as to attract the magnet disposed on the damper blade. Thus, when the fusible link is broken by high temperatures, the first magnet propels the damper blade toward the closed position, and the third magnet attracts the damper blade to assist in putting it into a fully closed position. The third magnet and second magnet then cooperate to effect a secure closure, which is supplemented by mechanical locks disposed in the vent housing.

9 Claims, 5 Drawing Sheets

MAGNETICALLY ACTUATED AUTO-CLOSING AIR VENT

CROSS REFERENCES TO RELATED APPLICATIONS

The present application claims the benefit of U.S. Provisional Patent Application Ser. No. 60/910,142, filed Apr. 4, 2007, (Apr. 4, 2007).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to air vents used in building structures, and more particularly to air vents having automatic damper operation apparatus, and still more particularly to a fire safety magnetically driven auto-closing vent for soffits and walls that connect the exterior of a building to its interior or that connect adjoining rooms in a building. The inventive apparatus prevents the rapid ingress of fire and fire gasses in buildings through the vents of a ventilating system.

2. Discussion of Related Art Including Information Disclosed Under 37 CFR §§1.97, 1.98

The 2007 wildfires in San Diego and Orange counties, California, have highlighted the vulnerability of commercial and residential structures to rapidly spreading wildfires. It has been observed that fires frequently enter structures through vents in attics, soffits and foundations, and that they may spread through buildings through wall vents. A highly publicized case described the destruction of an expensive home originally constructed to be effectively fireproof. Exterior walls of the house were covered with stucco and the roof was protected by roof tiles. However, these features failed to stop the complete destruction of the home by fire, as the fire easily entered the house through attic air vents exposing the interior of the house to the outside atmosphere. Once ignited, the dry interior of the attic burned uncontrolled and resulted in the complete destruction of the home and its valuable contents.

While this and other similar incidents highlight the problem of fire access through vents, there is as yet no commercially viable solution proposed to the problem. The present invention represents a solution by providing a vent having a magnetically driven, automatically closing damper, which is ordinarily retained by a thermal fuse that releases at a predetermined temperature. After release, the damper is secured in a locked and closed position with magnetic and mechanical latches.

Other fire damper vents are known. For instance, U.S. Pat. No. 6,676,508, to Graham, teaches a magnetically controlled air flow system having a pivotable flap with a permanent magnet at distal ends. Two coils with magnetizable cores are mounted inside the air duct and positioned so as to engage the permanent magnet when the flap is in either a closed or an open position. By energizing the coils, the permanent magnet is attracted to the magnetizable cores in either one of the coils, thereby actuating the flap between the closed and open positions.

U.S. Pat. No. 6,681,863, to Odelros, shows a method and apparatus for preventing distribution of fire gases in a ventilating system. The system detects and responds to pressure drops at a measuring point at the inlet side or the outlet side. When a significant low pressure is registered, the damper is closed to block air flow past the measuring spot.

Especially pertinent for the present case is U.S. Pat. No. 7,018,289, to Heil, et al., which describes a damper assembly having a damper blade kept in an open position by a fusible link connected to the damper blade. A biasing force tends to urge the damper blade to a closed position. The fusible link fails upon an occurrence of a predetermined condition. A damper mechanism is provided including a locking mechanism linked to the damper blade that resists opening of the damper blade when the blade has closed due to failure of the fusible link.

U.S. Pat. No. 4,080,978, to McCabe, discloses a rotating blade, smoke, fire and air control damper with spring closures attached on both inside and outside surfaces of the blades. The spring closures cooperate with a bimetallic heat sensing device to trigger the closing of the blades at a predetermined temperature. The spring closure means acts with opposing forces through the blade linkage to "snap" close the blades and to retain the blades in that position even in the presence of fires. The springs are mounted on bracket supports attached to inner and outer blade surfaces with the free ends attached to opposing alternate ends of the frame. The bimetallic link may be mounted to automatically reset when recycled.

U.S. Pat. No. 3,650,069, to Alley, teaches a fire damper blade latch mounted to swing on a horizontal axis between an open position and a closed position across either a horizontal or a vertical duct. The blade is normally held open by a fuse and is weighted to swing by gravity to closed position across the duct when released. The blade includes a latch is mounted on the outer side of the blade and strikes a catch as the blade closes. The latch plate weighs the plate to swing it into locked position behind the catch when the damper blade reaches closed position.

The foregoing patents reflect the current state of the art of which the present inventors are aware. Reference to, and discussion of, these patents is intended to aid in discharging Applicants' acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The present invention is a fire-retarding air vent having an auto-closing, magnetically actuated damper. The damper is typically secured in an open position through a thermal fuse which connects the damper blade to an interior side of the vent housing. At least one magnet is disposed on the interior side of the damper blade. A magnet having a polarity opposite that of the damper blade magnet is disposed on an interior side of the vent housing, and while in the open position, the two magnets are in relative proximity, such that the repulsive force of the magnets tends to urge the damper blade toward a closed position. The closure is restrained only by the thermal fuse.

Thus, when a predetermined temperature threshold is reached, which temperature is sufficiently high to break or melt the thermal fuse, the blade will swing into a closed position. A third magnet, disposed on or proximate the back side of the vent housing, then secures the damper blade in the closed position. The closure is further secured by spring biased mechanical locks.

As is clear from the selected background art references, there exist numerous self-closing vents in that employ springs, weights, levers and intumescent materials that close vents when exposed to fire. However, vents are routinely installed in places exposed to moisture, and the resulting corrosion degrades the functioning of critical mechanical devices. Accordingly, the present invention uses permanent magnets as the motive force to urge the damper into a closed and locked position. The only moving part of the inventive device is the hinged damper, which is pivotally fixed to the frame with a non-corroding hinge at two pivot points. Mechanical locks aid a magnetic latch to prevent back draft from re-opening the vent once it is closed. This redundancy is critical to reliable use in fire safety, since springs can melt, and permanent magnets degrade and fail when the Curie temperature is reached. Fortunately, magnets of sufficient strength and temperature tolerance for specific applications are available.

In an alternative embodiment of the present invention, a helical compression spring may be disposed between the damper and the vent housing to provide mechanical redundancy in driving the damper closed. While not necessary for activation of the unit, such a feature may be prudent as a safety backup.

When placed in an outside wall or soffit, the damper in the auto-closing vent of the present invention closes from front to back. Thus, in addition to minimizing moving parts, the present invention uses drafts caused by an outside fire to assist in closing the damper. The auto-closing vent is adapted for use not only on fire-resistant buildings, such as one those with non-flammable exteriors, but conventional wood sided buildings as well. Importantly, the vent will retard entry of the fire for a critical period at the onset of the fire, and may thus provide more time for firefighters to save property and lives.

Accordingly, it is an object of the present invention to provide a self-closing vent suitable for original or retrofit installation in an exterior or interior wall or soffit.

It is another object of the present invention to provide a self-closing vent that uses magnets as the means to drive and propel a vent damper from an open position to a closed position.

It is still another object of the present invention to provide a self-closing vent having a damper blade restrained in an open position by a thermal fuse, which fuse releases when a predetermined temperature threshold is reached.

It is yet another object of the present invention to provide a self-closing vent that minimizes moving parts that may fail when exposed to high temperatures.

From the foregoing, it will be appreciated that another principal object of the present invention is to provide an apparatus that prevents or retards the distribution of fire gases in a ventilating system.

Still another object of the present invention is to prevent the spread of fire itself.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1A:
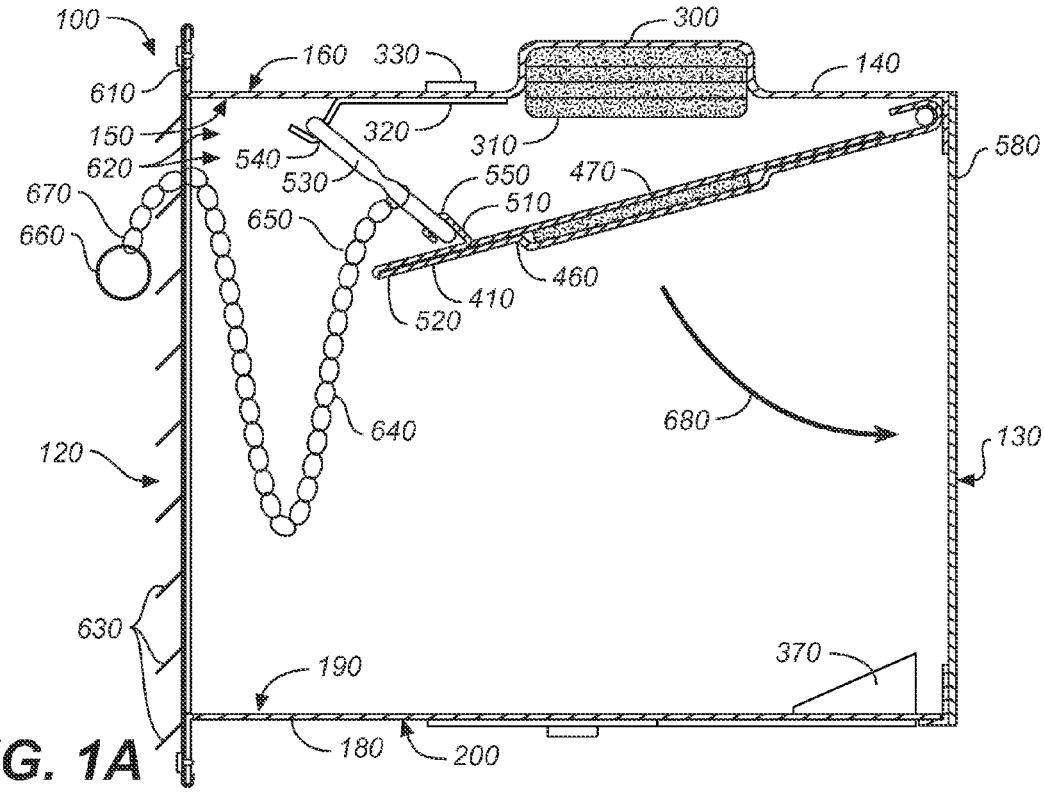
FIG. 1A is a cross-sectional side view in elevation of a first preferred embodiment of the auto-closing vent of the present invention, showing the damper blade secured in the open position.

Referring to FIGS. 1 through 6, wherein like reference numerals refer to like components in the various views, there is illustrated therein a new and improved magnetically actuated auto-closing vent, generally denominated 100 herein. Collectively, these views show that the inventive auto-closing vent includes a box-like vent housing 110 comprising: a generally open front 120; a generally open rear 130; a top panel 140 having an interior side 150, an exterior side 160, and a top mounting flange 170; a bottom panel 180 having an interior side 190 an exterior side 200 and a bottom mounting flange 210; a right side panel 220 adjoining and connecting each of the top and bottom panels and having a side mounting flange 230, and a threaded hinge pin hole 240 proximate the upper right rear corner through which a threaded right hinge pin (e.g., a sheet metal screw) 250 is threadably inserted; and a left side panel 260 adjoining and connecting each of the top and bottom panels and having a left mounting flange 270, and a hinge pin hole 280 proximate the upper left rear corner through which a left threaded hinge pin 290 is threadably inserted. The panels are fabricated from sheet metal and are either bent or connected at their edges in a manner well known in the art.

The top panel includes an integrally formed recess 300 in which a first permanent magnet 310 is disposed. A hook 320 is affixed to the interior side of the top panel using one or more rivets 330 or other attachment means.

First and second flexible metal springs 340, 350, are attached to the bottom panel with rivets 360. Each spring includes an integrally formed ramp 370, 380, each of which extends vertically through a transverse slot 390, 400 cut into the bottom panel. The springs function as mechanical locks for the damper blade, as is explained more fully below.

The vent next includes a damper blade 410 having an interior side 420, an exterior side 430, a top edge 440, and a bottom edge 450. The interior side includes an integrally formed recess 460 for placement of a second permanent magnet 470. The top edge includes a fold 480 forming a channel 490 along the length of the edge, and into which the right and left threaded hinge pins are inserted. In this manner, the damper is pivotally disposed within the vent interior space 500 through two hinge points so as to allow the damper to swing upwardly toward the interior side of the top panel so as to open the vent (FIG. 1A), and also toward the rear side so as to close the vent (FIG. 1B). The second magnet is oriented with its pole matching the outer pole of the first magnet, such that when brought into sufficient proximity with the first magnet, a strong repelling force tends to urge the damper away from the interior side of the top panel and toward a closed position. However, a second hook 510 is disposed on the interior side of the damper and is either integrally formed in panel material extending from a bottom fold 520 at the bottom edge of the damper, or is a separate article attached with rivets or other affixation means; and a fusible link 530 having upper and lower holes 540, 550, respectively, is connected to each of the first and second hooks, thereby placing and restraining the pivotally attached damper in an open position.

A removable spark and ember arresting screen 560 covers the rear side of the vent, and one or more rear side magnets 570, 580, 590, are mounted at the rear of the vent. If only a center magnet 570 is provided, this may be affixed to a ferromagnetic mount 600 extending upwardly from the bottom panel or downwardly from the top panel. This magnet is oriented with its inwardly facing side having an opposite polarity of that of the second magnet disposed on the damper. Accordingly, there is a strong attraction between the second and third magnets. Preferably, however, the magnets placed at the rear of the vent include at least two elongate magnets 580, 590 disposed in a vertical orientation from the rear edge of the top panel to the rear edge of the bottom panel. These are located away from the center of the rear and more toward the side panels, such that the magnets attract the ferromagnetic damper panel regardless of the orientation of the second magnet. Because typical ferrite magnets have a Curie point of approximately 82° C., neodymium magnets, having a Curie point of approximately 300° C., are preferred for most applications. When extremely valuable properties are involved, however, samarium cobalt magnets may be chosen, inasmuch as such magnets have a Curie point in the range of 680-700° C.

The vent will typically include a face plate 610 with a plurality of parallel air guiding slots 620 and louvre vanes 630. As an additional safety feature, an emergency release chain 640 may be connected at its interior end 650 to the lower hole of the fusible link, draped through one of the slots, and provided with a pull ring 660 at its outer end 670 for easy grasping. In the event that a building occupant wishes to close the damper before the fusible link reaches the temperature threshold for breaking and closing the damper automatically, the chain may be pulled and the damper closed manually.

Figure 1B:
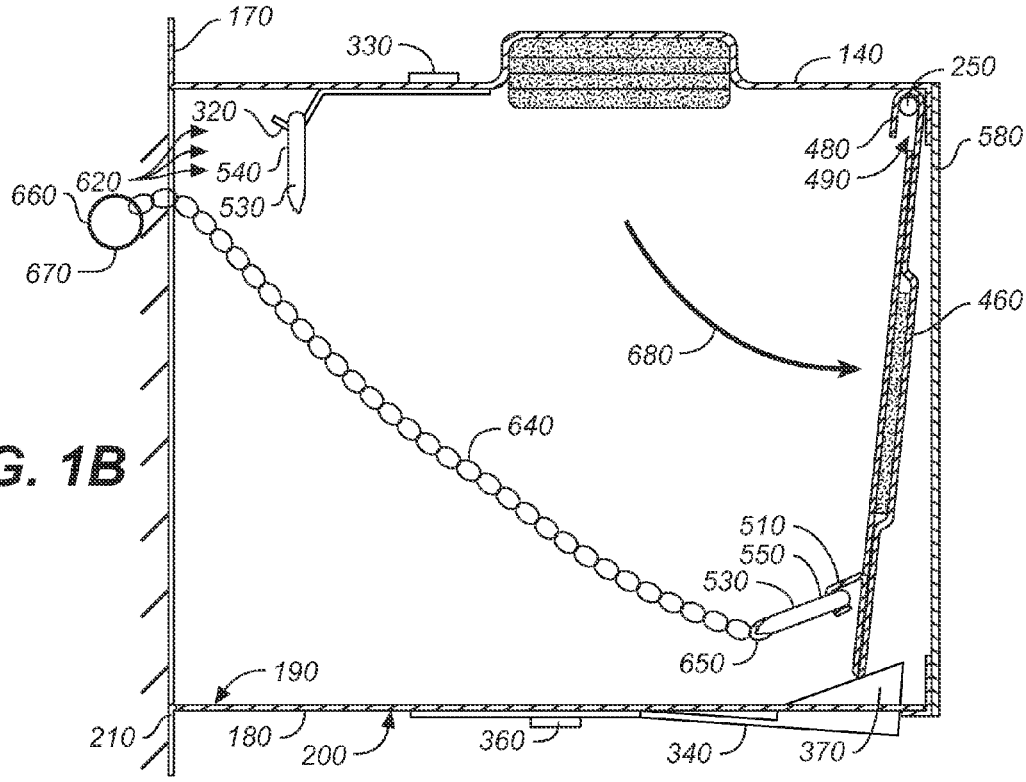
FIG. 1B is a cross-sectional side view in elevation, showing the damper blade as it passes over flexible metal spring mechanical locks.
Figure 1C:
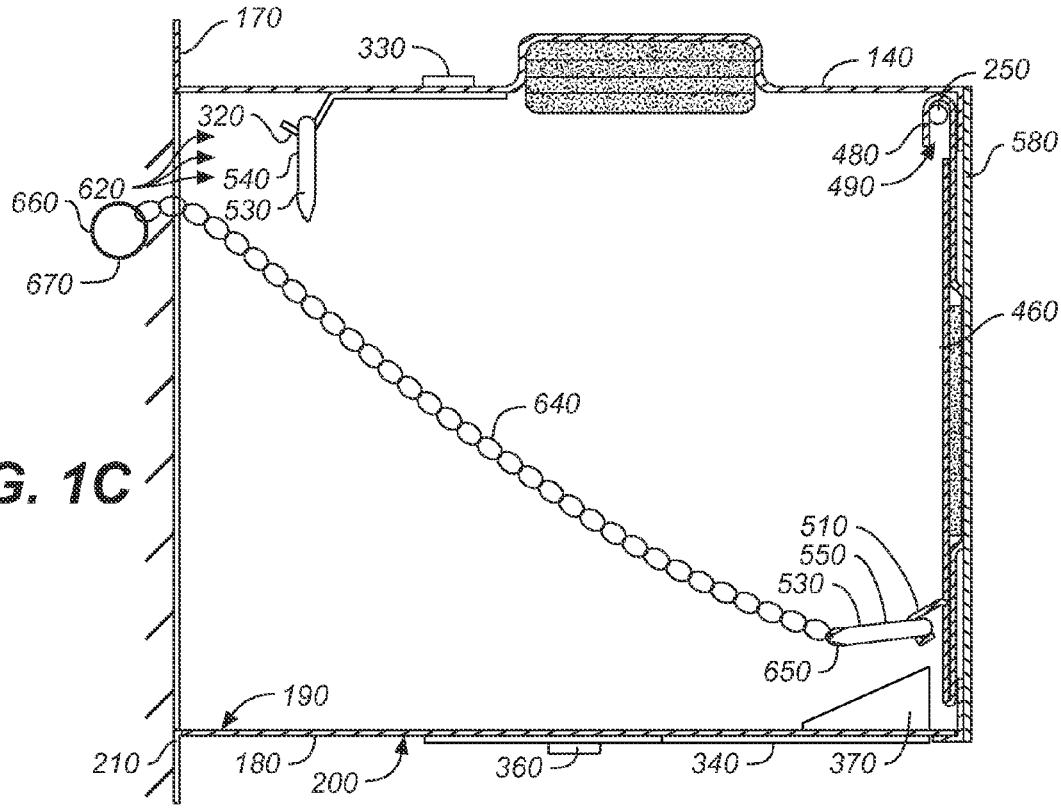
FIG. 1C is a cross-sectional side view in elevation as in FIG. 1, showing the damper blade in the closed and locked position.
Figures 2A, 2B:
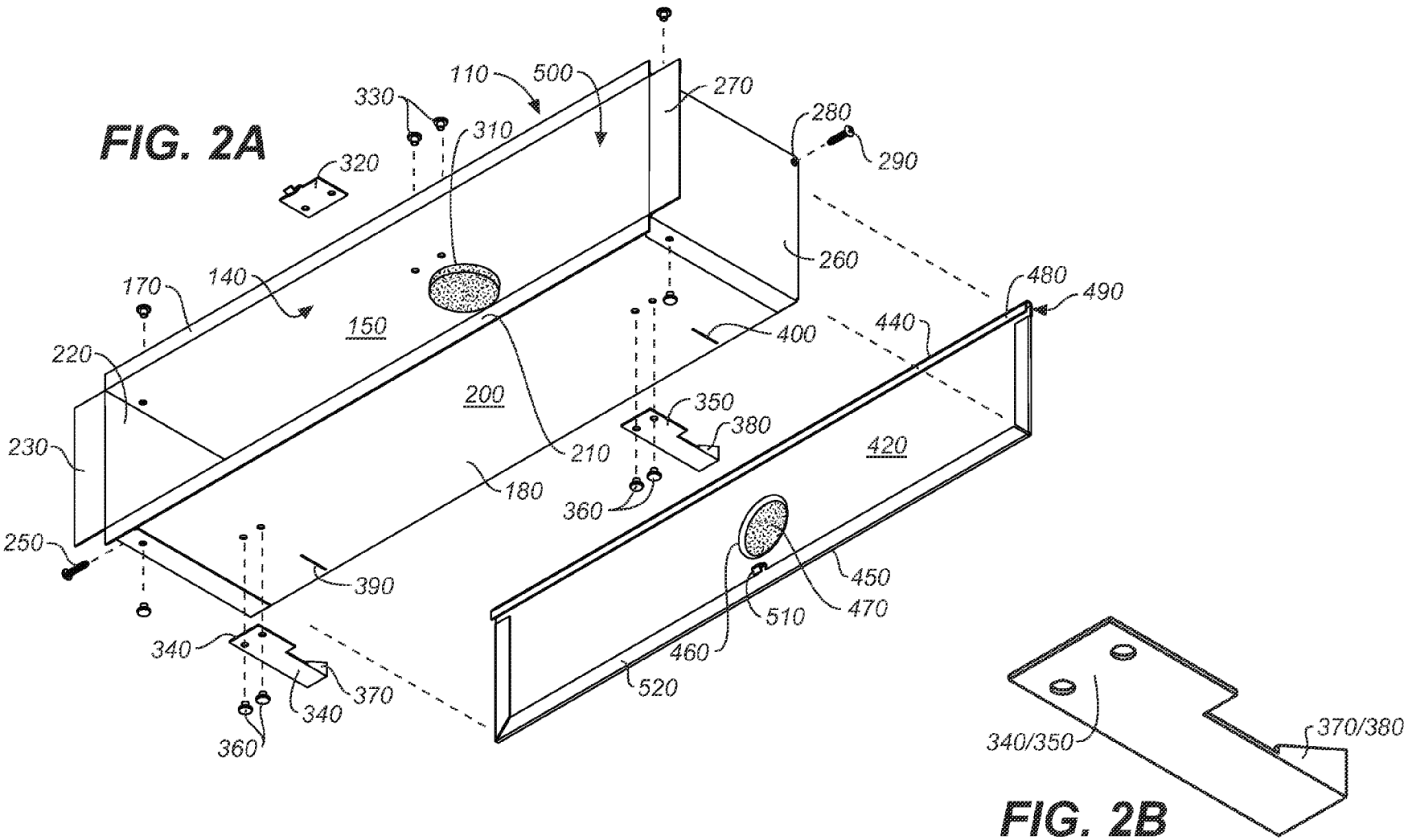
FIG. 2A is an exploded perspective view showing the structural elements of the first preferred embodiment of the inventive auto-closing vent.
FIG. 2B is a perspective view showing a mechanical lock.
Figure 3A:
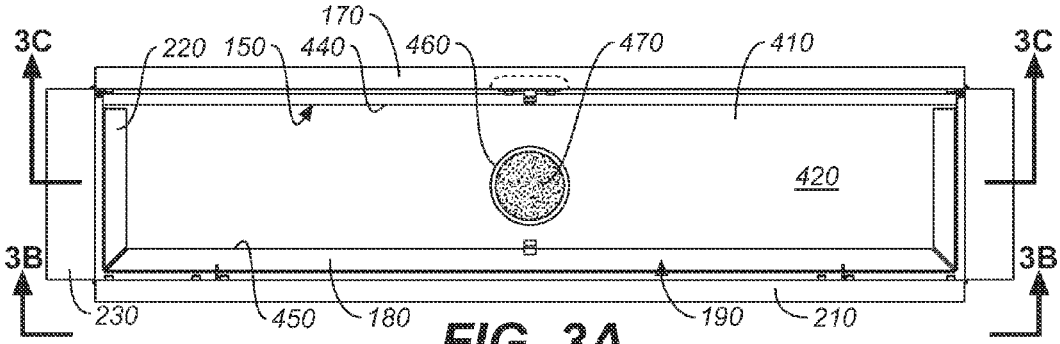
FIG. 3A is a front view in elevation of the inventive apparatus.
Figure 3B:
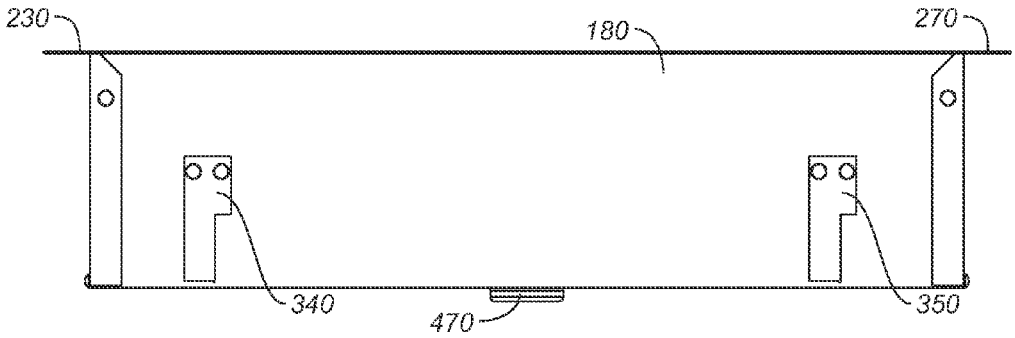
FIG. 3B is a bottom view thereof.
Figure 3C:
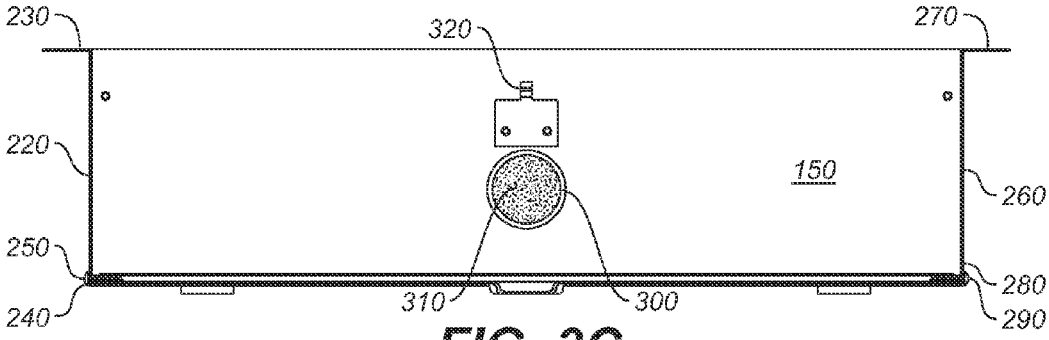
FIG. 3C is a top plan view thereof.
Figure 4:
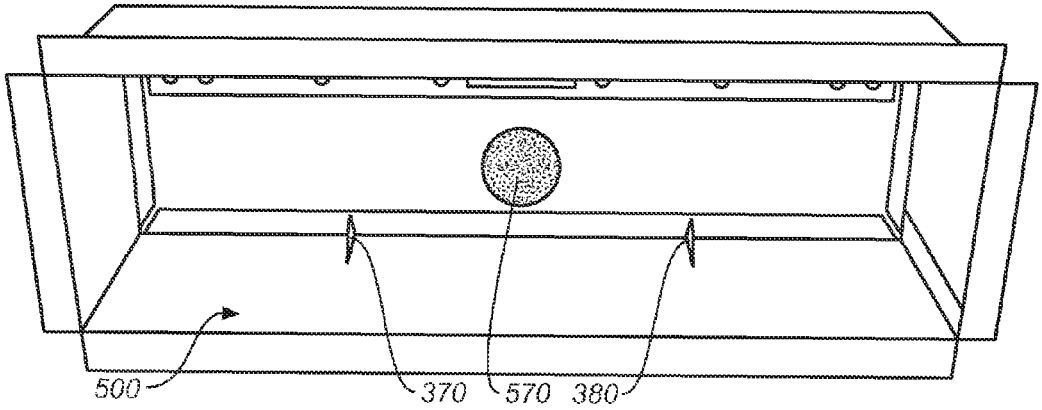
FIG. 4 is a front perspective view showing the damper blade in a closed and locked position.
Figure 5:
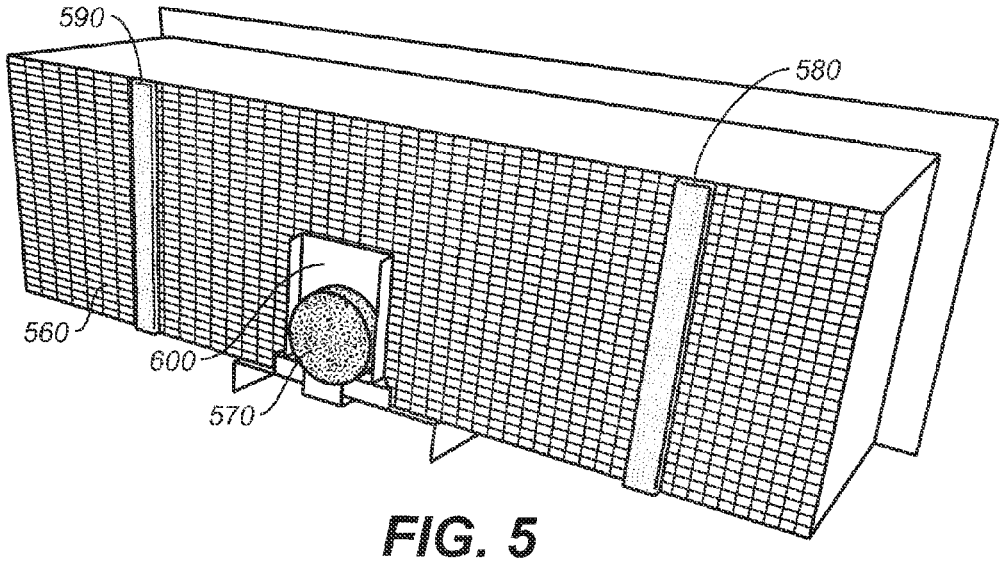
FIG. 5 is a rear perspective view thereof, also showing an alternative configuration of locking magnets.
Figure 6:
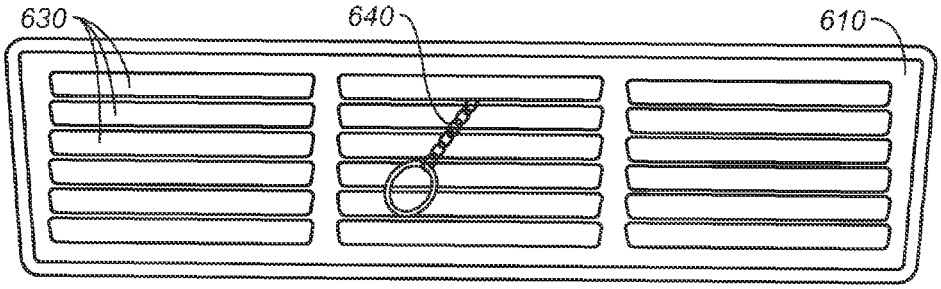
FIG. 6 is a front view in elevation showing a louvre cover on the inventive vent, and further showing a pull chain for manually initiating damper blade closure.

Referring now to FIGS. 1A through 1C, in operation, when the temperature sensitive fusible link reaches the breaking point temperature, or when the link is pulled or broken manually by pulling the emergency release chain, the repulsive force of the first and second magnets drives the damper into a downwardly swinging arc 680. As the damper approaches the rear of the vent, its bottom edge engages the ramp portions of the flexible metal springs (FIG. 1B), driving them downwardly as it passes over them. While the initial repulsive force (FIG. 1A) will be sufficient to effect a full closure of the vent, the attractive force of the magnets disposed at the rear of the vent assist by pulling the damper rearwardly. When the damper blade finishes passing over the ramps, the flexible metal springs drive upward and secure the damper blade in a closed position and completely prevent opening under forces normally encountered, even in severe fire.

The foregoing description makes clear that in its most essential aspect, the present invention is a magnetically-driven, automatically-closing vent comprising: (1) a vent housing having an open front end and an open rear end and a plurality of interior sides that define a volume between the front end and the rear end; (2) a first connector disposed on one of the plurality of interior sides; (3) a damper blade pivotally disposed in the vent housing interior, the damper blade having an open configuration and a closed configuration, wherein when in the closed configuration the damper blade substantially prohibits the passage of air through the vent housing; (4) a second connector disposed on the damper blade; (5) a first permanent magnet disposed on the damper blade; (6) a second permanent magnet disposed on one of the plurality of interior sides and oriented in such a manner that when the damper blade is pivoted toward into the open configuration, the first magnet and the second magnet repel each other and tend to urge the damper blade toward the closed configuration; and (7) a temperature sensitive fusible link disposed between the first connector and the second connector. The structural elements provide means whereby when the fusible link is exposed to a sufficiently high temperature, the fusible link breaks, and the repelling force between the first and second magnets propels the damper blade into a closed position.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A fire safety auto-closing air vent, comprising:

a vent housing having a substantially open front and a substantially open rear;

a top panel having an interior side, an exterior side, and a top mounting flange, and a top panel recess;

a bottom panel having an interior side, an exterior side, a bottom mounting flange, and at least one transverse slot;

a right side panel adjoining and connecting each of the top and bottom panels and having a side mounting flange and a threaded hinge pin hole proximate its upper right rear corner and through which a threaded right hinge pin is threadably inserted;

and a left side panel adjoining and connecting each of said top and bottom panels and having a left mounting flange and a hinge pin hole proximate its upper left rear corner through which a left threaded hinge pin is threadably inserted;

a first permanent magnet disposed in said top panel recess;

a first hook affixed to said interior side of said top panel;

at least one flexible metal spring attached to said exterior side of said bottom panel, each of said at least one spring having a ramp extending vertically through one of said at least one transverse slots in said bottom panel, said flexible metal spring locks adapted for use a mechanical locks;

at least one hinge disposed proximate said top panel;

a damper blade pivotally connected to said at least one hinge, said damper blade having an interior side, an exterior side, a top edge, a bottom edge, a damper blade recess on said interior side, whereby said damper swings either upwardly toward said interior side of said top panel or toward said rear of said open rear of said vent housing;

a second permanent magnet disposed in said damper blade recess, said second magnet oriented so as to be in a repelling relationship to said first magnet and such that said first and second magnets cooperate to urge said damper blade to swing downwardly toward said open rear of said vent housing;

a temperature sensitive fuseable link having an upper hole disposed over said first hook and a lower hole disposed over said second hook, thereby restraining said damper blade in an open position;

wherein when said fuseable link is broken by exposure to high temperature, said damper blade is repelled away from said top panel and into a downwardly curving arc toward said open rear of said vent housing, and wherein as said damper blade swings, said lower edge of said damper blade engages said ramp of said at least one flexible metal spring, pushing it downwardly such that said ramp is depressed in said at least one slot in said bottom panel so that said damper blades passes entirely over said ramp, and after passing over said ramp, said flexible spring is urged upwardly to secure said damper blade in a closed position.

2. The apparatus of claim 1, further including at least one rear magnet disposed on said rear of said vent housing.

3. The apparatus of claim 2, wherein said at least one rear magnet is a center magnet disposed on a mount extending from one of said panels of said vent housing and oriented so as to attract said second magnet on said damper blade as said damper blade approximates said rear of said vent housing.

4. The apparatus of claim 2, wherein said damper blade is fabricated from a ferromagnetic metal, and wherein said at least one rear magnet includes at least one vertically disposed elongate magnet extending from said top panel to said bottom panel, and oriented in any manner so as to attract said damper blade.

5. The apparatus of claim 1, wherein at least a portion of said top edge of said damper blade includes a fold proximate said right side panel and said left side panel, thereby forming a channel into which said hinge pins are pivotally disposed.

6. The apparatus of claim 1, further including a removable spark and ember arresting screen covering said open rear of said vent housing.

7. The apparatus of claim 1, further including a face plate having a plurality of air guiding slots.

8. The apparatus of claim 7, further including an emergency release chain connected at an interior end to said lower hole of said fuseable link, draped through one of said air guiding slots in said face plate, and having a pulling pull ring at its outer end for easy grasping.

9. The apparatus of claim 1, further including an emergency release chain connected at an interior end to said lower hole of said fuseable link and draped through said open front of said vent housing.

* * * * *